United States Patent [19]

De Foronda

[11] Patent Number: 4,969,503

[45] Date of Patent: Nov. 13, 1990

[54] AIR IMPACT MOLDING MACHINES FOR MAKING SAND MOLDS

[76] Inventor: Vicente L. De Foronda, Miravalles, 5 01013 Vitoria Alava, Spain

[21] Appl. No.: 422,914

[22] Filed: Oct. 18, 1989

[30] Foreign Application Priority Data

Oct. 21, 1988 [ES] Spain ..... 88 03220

[51] Int. Cl.[5] ..... B22C 15/00

[52] U.S. Cl. ..... 164/169; 164/37

[58] Field of Search ..... 164/169, 37

[56] References Cited

U.S. PATENT DOCUMENTS 4,588,017 5/1986 Damm et al. ..... 164/169

4,609,033 9/1986 Kobel et al. ..... 164/169

*Primary Examiner*—Richard K. Seidel

*Assistant Examiner*—J. Reed Batten, Jr.

*Attorney, Agent, or Firm*—Helfgott & Karas

[57] ABSTRACT

The machine includes a compressed air bell-shaped ejector, a sand supplying hopper positioned above a diffuser located over a molding box receiving sand from the hopper. The sand supplying hopper is arranged axially inside the compressed air bell-shaped ejector so that an annular mouth is defined, which surrounds a sand discharge mouth of the hopper. The mouth of the hopper and the mouth of the ejector both face the diffuser which closes the top of the molding chamber. A valve for closing the bell-shaped ejector includes a tubular membrane which is adapted and fixed at its edges to the internal surface of the diffuser, at a coaxial portion thereof which faces the hopper.

6 Claims, 1 Drawing Sheet

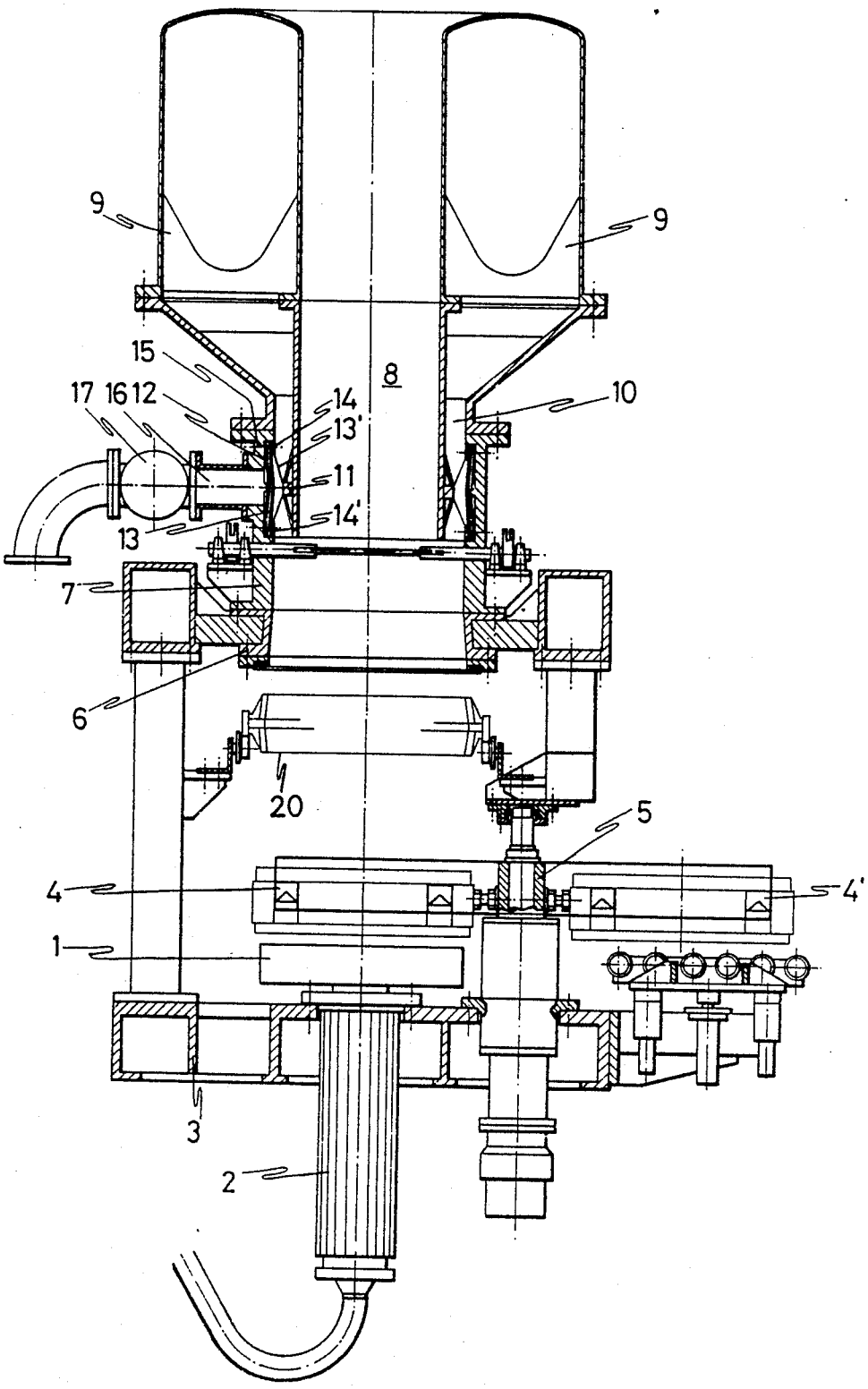
9
9
15
8
17 16 12
14
13'
10
11
14'
13
7
6
20
5
4
4'
1
3
2

AIR IMPACT MOLDING MACHINES FOR MAKING SAND MOLDS

FIELD OF THE INVENTION

The present invention relates to air impact molding machines, specifically machines designed for obtaining sand molds, from the respective patterns.

BACKGROUND OF THE INVENTION

Known air impact molding machines generally comprise a lower table, with a pattern plateholder arranged thereon, a box positioned over the latter and a frame provided on the box, all of which elements may be axially and telescopically coupled and uncoupled as appropriate to form a tight block with the pattern lying on its bottom where it can at any time receive through an upper diffuser the amount of sand needed to form the mold and at some other time be acted on by a bell-shaped ejector that can furnish the sand with the necessary air impact to compact the same and definitely form the mold.

Therefore and in the light of the above, the bell-shaped ejector and the sand supplying hopper must alternatively face the operative block wherein the actual molding takes place, which entails that such elements must be able to move with respect to the packet, and the pattern plateholder must also move so that the packet may be provided with each new pattern and the sand mold formed therein may be removed.

There are machines wherein the bell-shaped ejector and the sand hopper are established on a slide that can move crosswise and take up two working positions, viz. either with the operative molding block axially facing the bell-shaped ejector, where the sand hopper receives a new amount, or with the said sand hopper actually facing the molding block, whilst the bell-shaped ejector remains on one side and is at rest.

In another type of air impact molding machines, the bell-shaped ejector and the sand hopper are established on a revolving shaft that defines their above-mentioned two positions with respect to the operative molding block.

The pattern plateholder, in some existing machines is assembled on a slide that may move in opposite directions and in the machines of another type it is assembled on a revolving shaft, so that the plates at all events have two supports, one taking part in the operative molding block, whereas the other one allows the simultaneous removal of the sand mold which has already been formed and the appropriate substitution of the pattern.

In order to discharge the bell-shaped ejector, conventional machines of this type are fitted with a short cylindrical nozzle just above the deflector which normally seats a diaphragm located in an imaginary plane extending at the right angle to the ejector axis, which diaphragm is kept pressed against its seating, disconnecting the ejector and the molding area, through the pressure medium entering a chamber provided for such purpose on the diaphragm, so that when such pressure, which is greater than the pressure in the ejector, is ceased, the diaphragm is suddenly opened and so does the ejector to suddenly discharge onto the molding area.

This conventional system, however, implies that the ejector and the diffuser must be connected peripherally and with a double bend, so that the air first of all flows down the ejector peripheral area, then up towards the diaphragm and then down again through the diffuser, such a labyrinthine path entailing, on the one hand, a loss of load and, on the other hand, that the air impact will mostly take place at the central area of the sand mass constituting the mold, such air impact being rather smaller at the peripheral areas of the mold, especially at the corners, where the mold should be the hardest since those surfaces will serve to handle the same.

SUMMARY OF THE INVENTION

It is an object of the present invention to provide an air impact molding machine of a simplified structure with an improved performance, since air discharge or impact takes place with a smaller loss of load and under better operating conditions, specifically acting not only on the central area of the sand mass but also and specifically on the peripheral area thereof.

In order to achieve the above and other objects an impact molding machine is suggested in which the bell-shaped ejector and the sand supplying hopper are coaxially coupled inside each other; specifically a sand hopper unloading nozzle is positioned inside the bell-shaped ejector, and therefore such elements lose the classical and unavoidable mobility to become fixed, since due to their specific positioning they may alternatively work without changing their position, as they both face the molding area coaxially, and by merely duly blocking the sand unloading hopper when the bell-shaped ejector is discharging.

In accordance with another feature of the invention, the bell-shaped ejector, comprises a ring which, instead of being axially deformed as known in conventional machines, is radially deformed, and is specifically provided in the periphery of the cylindrical bell-shaped ejector nozzle to couple the same to the diffuser. This ring, when being deformed by the pressure supplied to an annular chamber surrounding the ring, presses onto a likewise annular seating provided outside the sand hopper discharge nozzle, tightly closing the bell-shaped ejector, whereas when the pressure acting peripherally on said ring is ceased, the latter leaves the annular space defined between the bell-shaped ejector and the sand hopper clear, and therefore a straight path is defined between the bell-shaped ejector and the air impact area on the sand mass, with no obstacles causing losses of loads, decreasing the air impact and, with such impact largely tending towards the sand mold periphery, location of the deflectors is necessary so that the air is distributed in a more uniform manner and impact also affects the central area of the sand mass constituting the mold.

BRIEF DESCRIPTION OF THE DRAWINGS

The single FIGURE of the drawings diagrammatically and partially shows an air impact molding machine in accordance with the present invention.

DETAILED DESCRIPTION OF THE PREFERRED EMBODIMENT OF THE INVENTION

Referring to the drawing in greater detail, the machine in accordance with the invention comprises, as any conventional machine of this sort, a table 1 which may travel vertically by action of a hydraulic or pneumatic cylinder 2 assembled on a relevant framework 3, with a pattern plateholder 4 placed on table 1 complementing another plateholder 4' assembled diametrically opposite to plateholder 4 on a revolving shaft 5, so that when the plateholder 4 faces the table 1 and takes part in the formation of a new mold, the other plateholder 4' simultaneously allows the removal of the sand mold already produced and appropriately a new pattern plate is positioned in place of the relevant one. Vertically above the table 1, is positioned a conventional molding box 20, and over box 20 the likewise conventional or classical frame 6, and finally a diffuser 7 on which a bell-shaped ejector 9 and a sand hopper 8 shall act. Frame 6 and diffuser 7 are duly stiffened to the machine framework or fixed structure 3, whereas the box 20 and pattern plateholder 4 may be either coupled to the former, constituting a tight container, when table 1 rises, or become detached therefrom, moving downwards, in order that the pattern plateholder 4 may in turn swing and be substituted by plateholder 4', and vice versa.

One of the characteristics of the present invention is based on the fact that, as clearly shown in the FIGURE, the sand hopper 8 is co-axially positioned inside the bell-shaped ejector 9 which therefore takes up an annular configuration, so that both, the mouth of the sand hopper 8 and the mouth of the bell-shaped ejector 9 face the diffuser 7 permanently, and therefore the hopper and the bell-shaped ejector are fixed to the machine framework, specifically through the diffuser 7, rather than being movable elements, that may move alternatively or else assembled on a revolving shaft, as has been provided in conventional machines.

In accordance with another characteristic of the invention, between the lower end area of the hopper 8 and the likewise lower end area of the bell-shaped ejector 9, there is positioned an annular and cylindrical nozzle 10, coaxial with the actual hopper 8 and bell-shaped ejector 9, and likewise coaxial with a molding chamber defined by box 20, frame 6 and diffuser 7.

In the annular nozzle 10 and, more specifically on the external surface of the hopper 8, there is established an annular seating 11, and at the same time as facing the same, specifically on the internal surface of the respective hopper 9 sector, there is established a groove or houing 12 for a tubular-shaped membrane valve 13 which is fixed in the groove 12 through its edges with the help of respective rings 14 and 14' and clamping screws 15. A conduit 16 leads into the bottom of groove 12 for admission of air under pressure. The conduit 16 is fitted with a control valve 17, so that when the pressure of the air entering the groove 12 is greater than the pressure in the bell-shaped ejector 9, the membrane of valve 13 is deformed towards the position indicated a 13' where the membrane presses onto the valve seating 11 and consequently blocks communication between the bell-shaped ejector 9 and the diffuser 7, whereas, when the control valve 17 is closed and the pressure on the external surface of the membrane of valve 13 disappears, the membrane recovers its rest position corresponding to that when it is housed inside the groove 12, and the nozzle 10 is left almost entirely clear, whereupon air is suddenly discharged towards the molding chamber, and consequently impacts on the sand mass, on the one hand, with no load being lost, since the path of the air is absolutely straight and, on the other hand, affecting not only the central area of the sand surface, but also and specifically the peripheral area thereof, to affect the marginal areas of the mold, where a good compacting of the sand is needed, since such areas will subsequently be used to handle the mold.

The sand hopper 8 is provided with any suitable closing means, to avoid pressure loss through the same when air under pressure stored in the bell-shaped ejector 9 is discharged, and the actual sand hopper may be used as a subsequent compression relief means for the molding chamber defined by the box 20, the frame 3 and the diffuser, or a special conduit may be provided for such purpose, fitted with an appropriate compression relief valve. Such conduit may be preferably located right next to the membrane valve, i.e., just under the latter and in the actual diffuser as a control conduit of the membrane valve since the diffuser 7, as shown in the FIGURE, takes part with the actual bell-shaped ejector in the formation of the nozzle 10 communicating the bell-shaped ejector with the molding area, surrounding the sand hopper 8.

Thus, in accordance with the invention, on the one hand, the machine structure is simplified since the sand hopper 8 and the bell-shaped ejector 9 are two stationary elements requiring no driving system, and, on the other hand, performance of the machine is improved since a straight path is established for the air between the bell-shaped ejector and the molding area, with no bends typically determining load losses, and further the air mass impacts on the whole sand surface of the mold, or, in other words, compacting of the mold is homogeneous throughout the surface.

It is not considered necessary to extend the present description any further for an expert in the art to understand the scope of the invention and the advantages derived therefrom.

The materials, shape, size and arrangement of the elements may vary, provided that this does not imply a modification in the essentiality of the characteristics of the invention.

The terms used to describe the present specification should be understood to have a wide and non-limiting meaning.

I claim:

1. An air molding machine for making sand molds, comprising a table, means to vertically move said table, two pattern plate holders positioned above said table on a revolving shaft diametrically opposed each other, a stationary machine frame supporting said shaft, a molding box, and a diffuser positioned above said molding box to form with said table, said plate holders and said molding box, a molding chamber which is tightly closed during an air impact onto said molding box and is open upon elevating said table to remove a sand mold from said molding box; a sand supplying hopper positioned above said chamber to supply sand into said molding box; a bell-shaped ejector providing an air impact into said chamber to compact the sand in said molding box, said sand supplying hopper and said ejector being rigidly connected to said stationary frame, said sand supplying hopper being positioned inside said ejector and concentrically therewith so as to define therebetween an annular space connected to said ejector and opening into said diffuser, said sand supplying hopper having a central mouth opening into said diffuser; and means blocking said sand supplying hopper when said ejector is discharging air into said chamber.

2. The machine according to claim 1, wherein said blocking means includes a tubular membrane valve coaxial with said diffuser and including a membrane connected at edges thereof to said diffuser; and further including means to supply pressure air to said membrane valve, said valve further including a valve seat positioned on an external surface of said sand supplying hopper, and means to control pressure of air in said pressure air supply means so that said pressure acts on said membrane to deform said membrane and press it against said seat to block said annular space.

3. The machine according to claim 2, wherein said diffuser includes a portion connected to said annular space to form therewith an air outlet nozzle, said portion being provided with a peripheral groove which houses said membrane which together with said seat is positioned in said air outlet nozzle.

4. The machine according to claim 3, wherein said membrane is fixed at the edges thereof to said diffuser by two rings screwed to said diffuser.

5. The machine according to claim 4, wherein said means to supply pressure air to said membrane valve includes a conduit opening into a bottom of said groove.

6. The machine according to claim 1, wherein said diffuser is rigidly connected to said frame and to said ejector.

* * * * *